US009976828B2

(12) United States Patent
Pagac

(10) Patent No.: US 9,976,828 B2
(45) Date of Patent: May 22, 2018

(54) FLEXIBLE TRIGGER PLUG

(71) Applicant: Stephen J Pagac, Tucson, AZ (US)

(72) Inventor: Stephen J Pagac, Tucson, AZ (US)

( * ) Notice: Subject to any disclaimer, the term of this patent is extended or adjusted under 35 U.S.C. 154(b) by 0 days. days.

(21) Appl. No.: 14/927,296

(22) Filed: Oct. 29, 2015

(65) Prior Publication Data

US 2016/0245605 A1 Aug. 25, 2016

Related U.S. Application Data

(63) Continuation-in-part of application No. 14/631,599, filed on Feb. 25, 2015.

(51) Int. Cl.
*F41A 17/54* (2006.01)

(52) U.S. Cl.
CPC ..... *F41A 17/54* (2013.01)

(58) Field of Classification Search
CPC ..... F41A 17/54
USPC ..... 42/70.06, 70.07, 70.11
See application file for complete search history.

(56) References Cited

U.S. PATENT DOCUMENTS 3,713,239 A * 1/1973 Sperling ..... F41A 17/54 42/70.07
3,956,842 A * 5/1976 Ballenger ..... F41A 17/54 42/70.07
5,033,218 A * 7/1991 Nelson ..... F41A 17/54 42/70.07
5,400,538 A * 3/1995 Shannon ..... F41A 17/54 42/70.06
5,544,440 A * 8/1996 Stockman ..... F41A 17/54 42/70.06
D375,342 S * 11/1996 Collins ..... D22/108
5,755,054 A * 5/1998 Tuller ..... F41A 17/54 42/70.07
5,910,002 A * 6/1999 Hunter ..... F41A 17/54 42/70.07
8,443,626 B2 * 5/2013 Simpson ..... A44C 15/0035 63/12
8,677,781 B2 * 3/2014 Stoilas ..... A44C 7/001 63/12
D726,276 S * 4/2015 Pagac ..... D22/108
2002/0029507 A1 * 3/2002 Saltz ..... F41A 17/54 42/70.07
2013/0312306 A1 * 11/2013 Ruffin ..... F41A 17/066 42/70.07
2016/0109203 A1 * 4/2016 Madia, II ..... F41A 17/54 42/70.07

* cited by examiner

*Primary Examiner* — Michael D David
(74) *Attorney, Agent, or Firm* — Gavin J. Milczarek-Desai; Quares & Brady LLP

(57) ABSTRACT

A flexible adjustable trigger plug is a device that is utilized to prevent the accidental pressing and subsequent discharge of a firearm trigger. The device features a plug that may be fitted behind the trigger as well as a first lip and a second lip that are able to hold the plug in place behind the trigger. A first concave cavity and a second concave cavity are present as well in order to facilitate insertion and removal of the device by pressing. The device serves as a physical obstruction that prevents the trigger from being accidentally pressed. The device is flexible and may be adjusted by turning the device when in place behind the firearm trigger, allowing the device to be utilized with a wide variety of firearms. The device may feature a lanyard arch and opening that allow a lanyard clasp or clip to be secured to the device.

7 Claims, 14 Drawing Sheets

SECTION A-A

SECTION B-B

SECTION C-C

FLEXIBLE TRIGGER PLUG

This application is a continuation in part of U.S. patent application Ser. No. 14/631,599 filed on Feb. 25, 2015.

FIELD OF THE INVENTION

The present invention relates generally to a device for preventing the accidental discharge of a firearm. More specifically, the present invention is a flexible adjustable trigger plug composed of flexible rubberized material that is fitted behind the trigger of a firearm in order to prevent actuation of the firing mechanism and a resulting accidental discharge. The adjustability of the present invention allows the present invention to be utilized in a variety of spaces between a firearm trigger and a trigger guard.

BACKGROUND OF THE INVENTION

One of the most fundamental aspects of firearm safety is the need for a shooter to keep his or her finger off of a firearm's trigger unless the shooter is ready to discharge the firearm. This is a basic element of firearm safety and training and is facilitated by the presence of a trigger guard on a large majority of firearms. Poor trigger discipline can result in serious wounds and injuries as well as fatalities to both the shooter and bystanders. Trigger guards are designed as a physical barrier to reduce the likelihood of an accidental discharge and additionally allow a shooter to place his or her finger on the trigger guard, away from the trigger. However, due to the nature of a firearm trigger, there are many opportunities for a firearm trigger to become snagged on an object or levered by a key, pencil, or pen and accidentally discharge the chambered round in a firearm. Involuntary movement on the part of the shooter can result in the trigger being accidentally pulled as well, for example, if the shooter is startled, a key gets wedged in between the trigger and inner lining of a pocket or purse, a child pulls a firearm out of a purse leaving a parent or adult with no time to react, and similar situations. Although internal or external lockable or levered safeties are found in a minority of firearms, many firearms such as the common revolver and many small conceal-and-carry semiautomatic firearms do not have a quick-release safety mechanism. All built-in safety mechanisms for revolvers are additionally only effective for use in long-term storage. One of the most utilized means for ensuring that a trigger cannot be accidentally pressed is a trigger lock. A trigger lock often requires a combination, a key, or other multistep means of installing or disengaging and removing the lock from the trigger. While a trigger lock is a nearly foolproof means of preventing accidental discharge of the firearm, the trigger lock can be a hindrance when the shooter wishes to quickly remove the lock and use the firearm. There are a few trigger locks that use a one-step method for removal. However, these trigger locks are typically limited to specific models of firearms and still require multiple steps to install.

The present invention is a flexible and adjustable firearm plug that is fitted behind the trigger of a firearm. The present invention serves as a physical obstruction behind the trigger that prevents the trigger from being pulled and accidentally discharging the firearm. In addition to preventing the trigger from being accidentally pressed, the present invention may be quickly and easily removed when the user wishes to use the firearm, unlike a conventional trigger lock that requires a combination, a key, or some other means of installation or removal. The present invention may be used with a wide variety of firearms as the present invention is able to conform to the specific design of a firearm's trigger, receiver, and trigger frame due to the use of a flexible rubberized material that is formed into the present invention. Additionally, the present invention is designed to conform to a wide variety of firearm trigger spaces due to the ability to adjust to a larger or smaller space by turning the present invention when behind the trigger. Various alternative embodiments of the present invention are available in order to allow the present invention to be utilized with a variety of firearm designs.

The present invention is designed for ease of use and is flexible for use in a wide variety of firearms. Additionally, the present invention does not require multistep adjustments in order to install or remove. The present invention is not considered a safety mechanism, but rather an additional barrier against accidental discharge by blocking the firearm trigger from pulling back and discharging while still accommodating little effort in the installation and removal of the present invention in addition to being able to accommodate a variety of firearm designs and sizes.

DETAIL DESCRIPTIONS OF THE INVENTION

Figure 1:
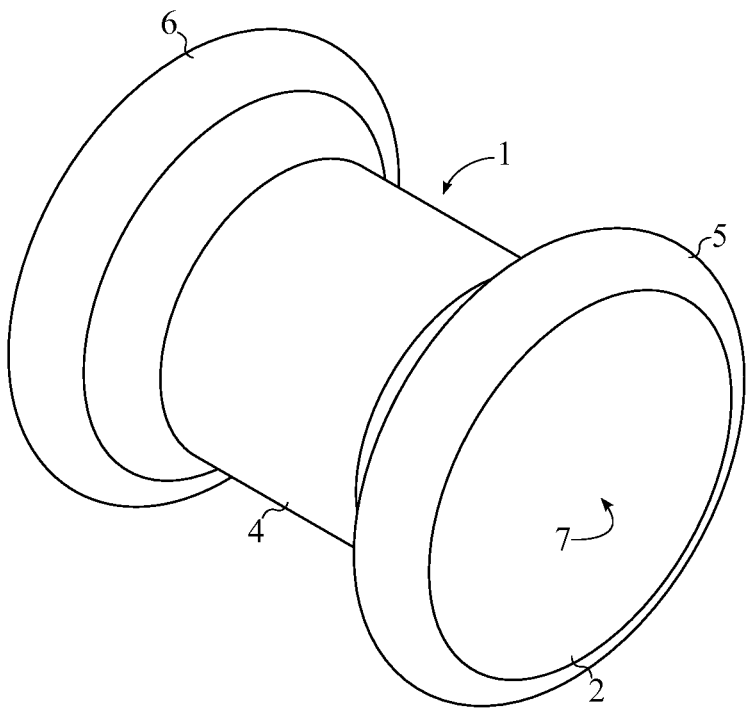
FIG. 1 is a perspective view of the present invention.
Figure 2:
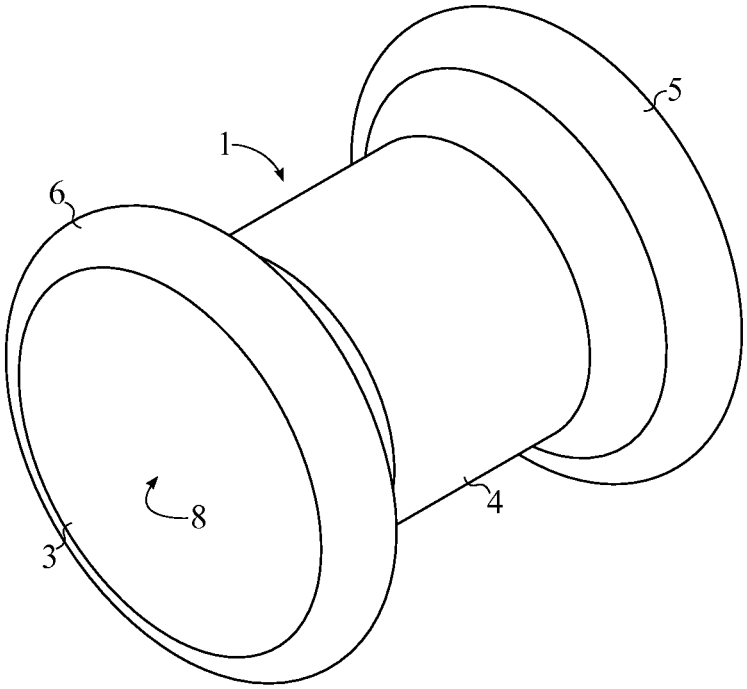
FIG. 2 is an additional perspective view of the present invention.
Figure 3:
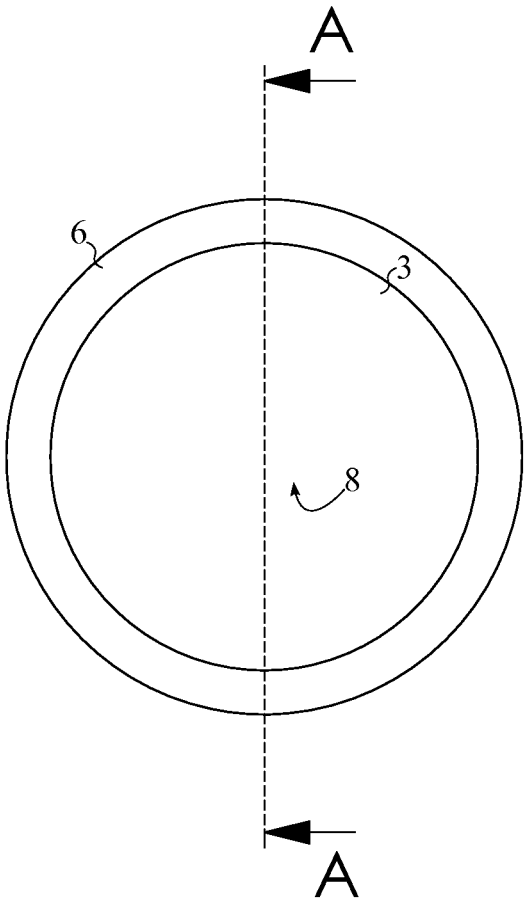
FIG. 3 is a side view of the present invention.

All illustrations of the drawings are for the purpose of describing selected versions of the present invention and are not intended to limit the scope of the present invention.

The present invention is a flexible adjustable trigger plug that physically obstructs a firearm trigger from being accidentally pulled and discharging the firearm. With reference to FIGS. 1-4, the present invention comprises a plug 1, a first lip 5, a second lip 6, a first concave cavity 7, and a second concave cavity 8. In the preferred embodiment of the present invention, the plug 1 is made of a flexible material allowing the present invention to be utilized with and accommodate a variety of firearms. In the preferred embodiment, the flexible material is a rubberized material, allowing the present invention to be slotted into and fitted behind the firearm trigger.

Figure 4:
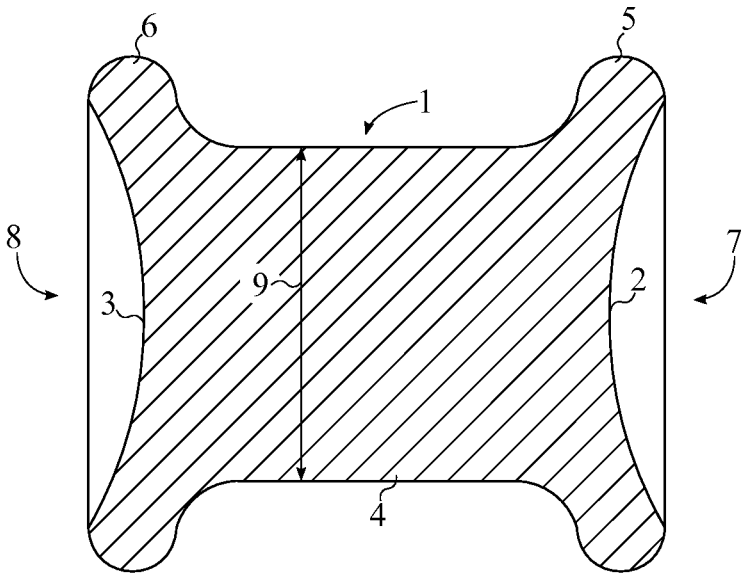
FIG. 4 is a cross-sectional view of the present invention taken along line A-A of FIG. 3.

The plug 1 is able to physically obstruct the space behind the firearm trigger, preventing the firearm trigger from being pressed. The plug 1 comprises a first base 2, a second base 3, and a lateral portion 4. The first base 2 and the second base 3 serve as mounting points for the first lip 5 and the second lip 6 while the lateral portion 4 separates the first base 2 and the second base 3. The first base 2 and the second base 3 are positioned opposite to each other along the lateral portion 4 and as such, the first base 2 and the second base 3 are positioned on opposing ends of the plug 1. In addition, the first base 2 and the second base 3 are positioned perpendicular to the lateral portion 4 allowing the first base 2 to be mirrored by the second base 3 across the lateral portion 4 as shown in FIG. 4.

The first lip 5 and the second lip 6 reduce the likelihood of the present invention being unintentionally removed from behind the firearm trigger. The first lip 5 is connected around the first base 2 while the second lip 6 is connected around the second base 3. As such, the first lip 5 and the second lip 6 are able to reduce the likelihood of the present invention being removed from behind the firearm trigger from either the first base 2 or the second base 3. The first lip 5 is positioned perpendicular to the lateral portion 4 while the second lip 6 is positioned perpendicular to the lateral portion 4 as well. The perpendicular positioning of the first lip 5 and the second lip 6 relative to the lateral portion 4 provides symmetry for the present invention.

The first concave cavity 7 and the second concave cavity 8 facilitate insertion and removal of the present invention into and out of the space behind the trigger. The first concave cavity 7 traverses up to the first base 2 while the second concave cavity 8 traverses up to the second base 3. As such, the first concave cavity 7 and the second concave cavity 8 are positioned on opposite ends of the plug 1 and allow the user to insert or remove the present invention from either the first base 2 or the second base 3.

Figure 5:
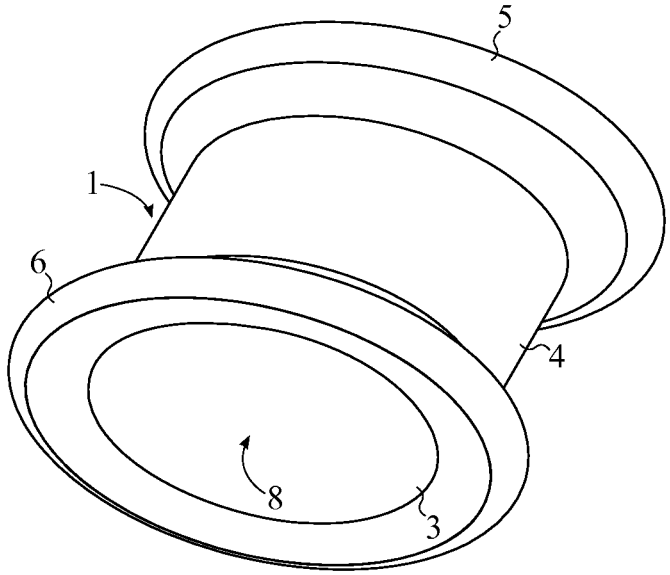
FIG. 5 is a perspective view of a first alternative embodiment of the present invention.
Figure 6:
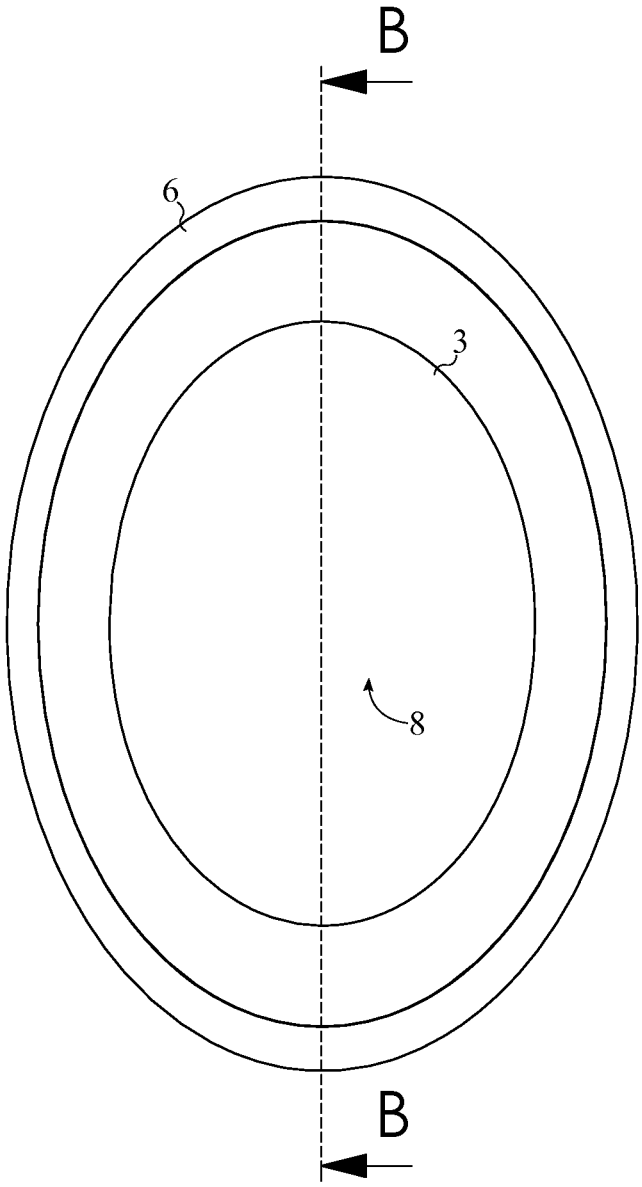
FIG. 6 is a side view of the first alternative embodiment of the present invention.
Figure 7:
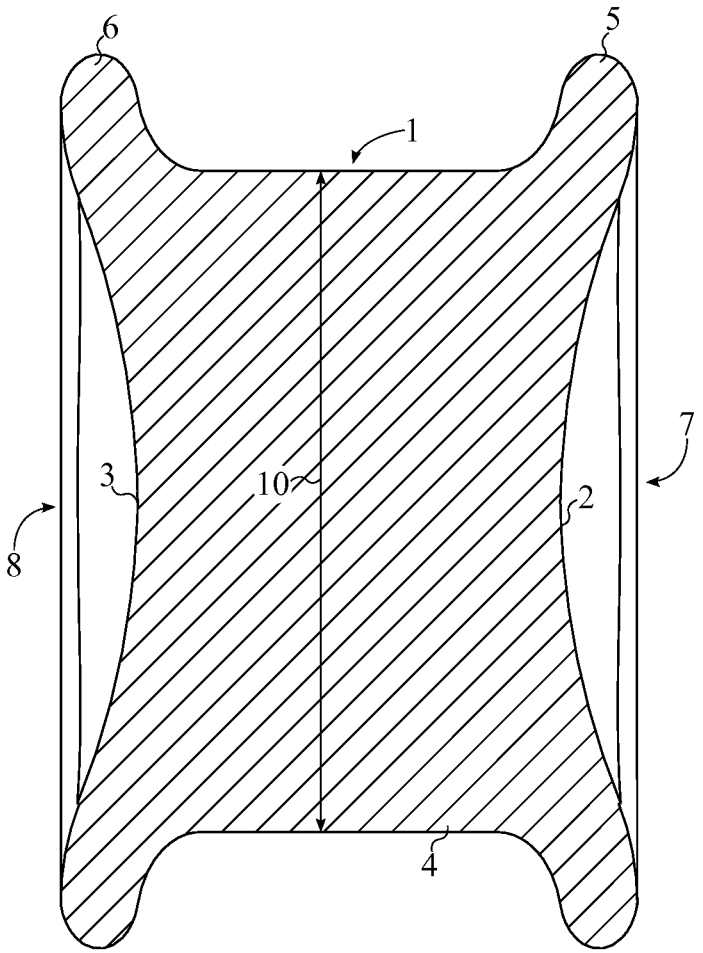
FIG. 7 is a cross-sectional view of the first alternative embodiment of the present invention taken along line B-B of FIG. 6.

The present invention further comprises a circular cross-section 9 of the plug 1. The circular cross-section 9 of the plug 1 provides the present invention with a rounded design, facilitating insertion of the present invention behind the trigger. The circular cross-section 9 of the plug 1 is positioned adjacent to both the first base 2 and the second base 3. As such, in the preferred embodiment of the present invention, the plug 1 is cylindrical in design. In a first alternative embodiment of the present invention shown in FIGS. 5-7, the present invention further comprises an oblong cross-section 10 of the plug 1. The oblong cross-section 10 of the plug 1 provides further versatility to the present invention by allowing the present invention to be utilized with a wider variety of firearms. The oblong cross-section 10 of the plug 1 is positioned adjacent to both the first base 2 and the second base 3 and as such, the oblong cross-section 10 extends from the first base 2 to the second base 3 along the lateral portion 4.

Figure 8:
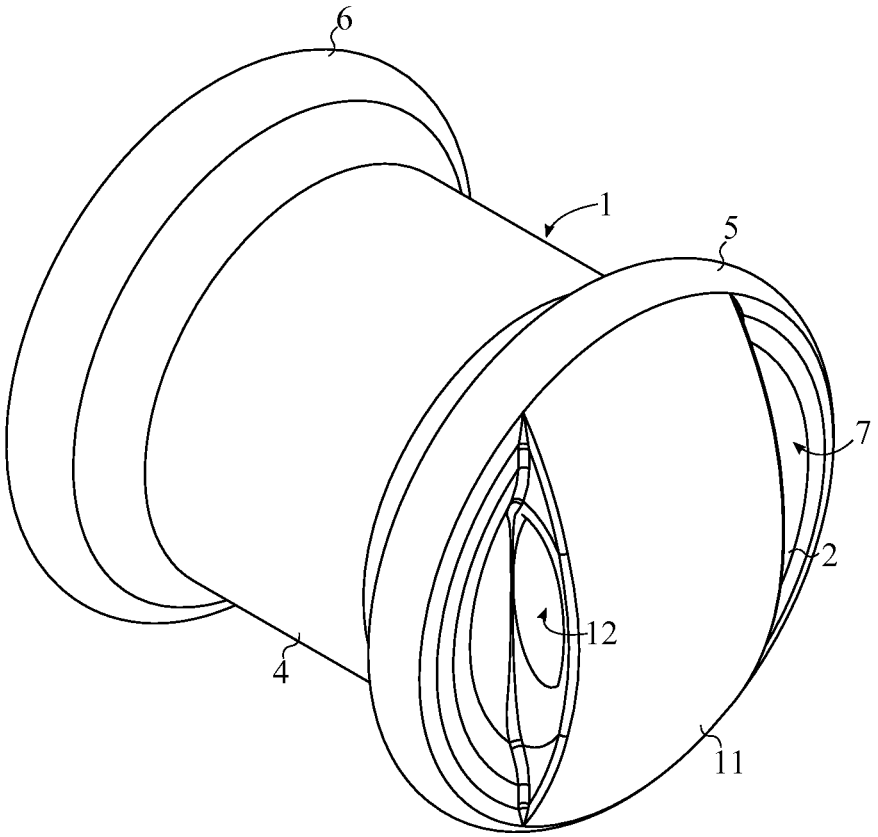
FIG. 8 is a perspective view of a second alternative embodiment of the present invention.
Figure 9:
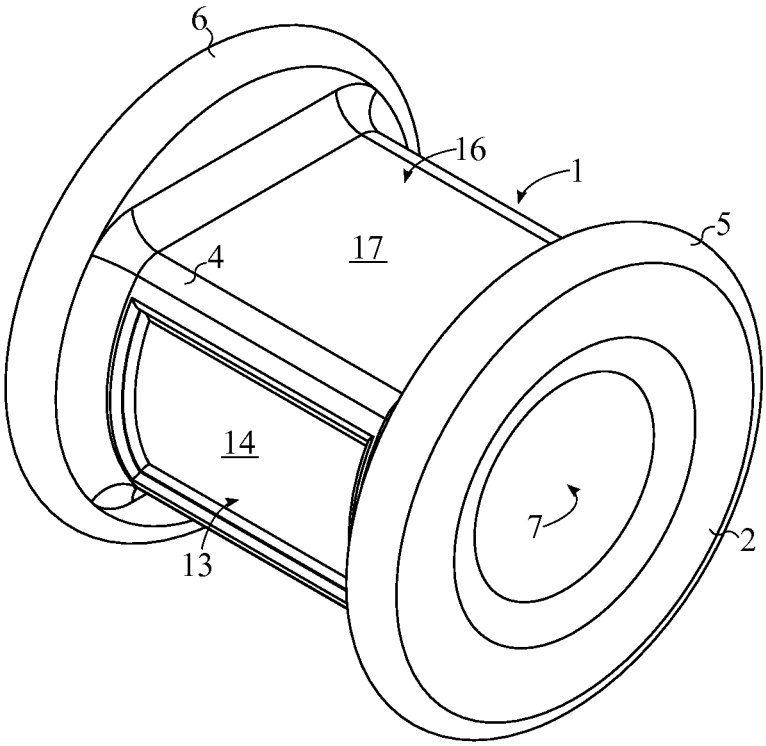
FIG. 9 is a perspective view of a third alternative embodiment of the present invention.
Figure 10:
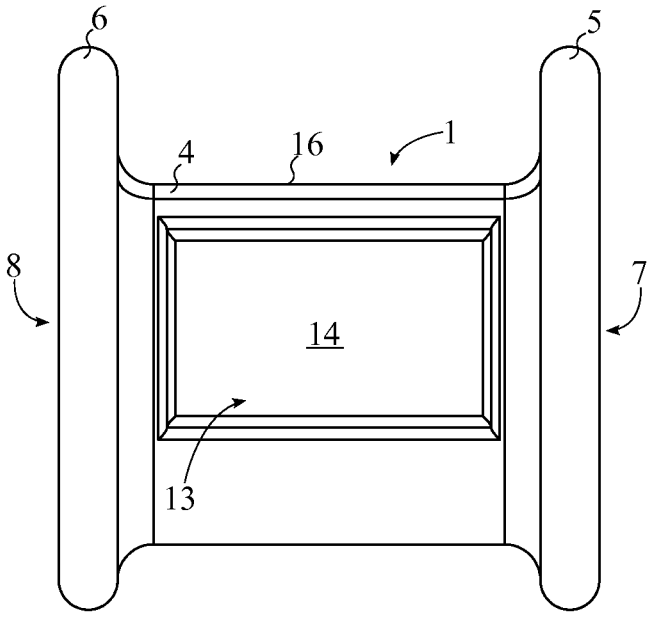
FIG. 10 is a front view of the third alternative embodiment of the present invention.
Figure 11:
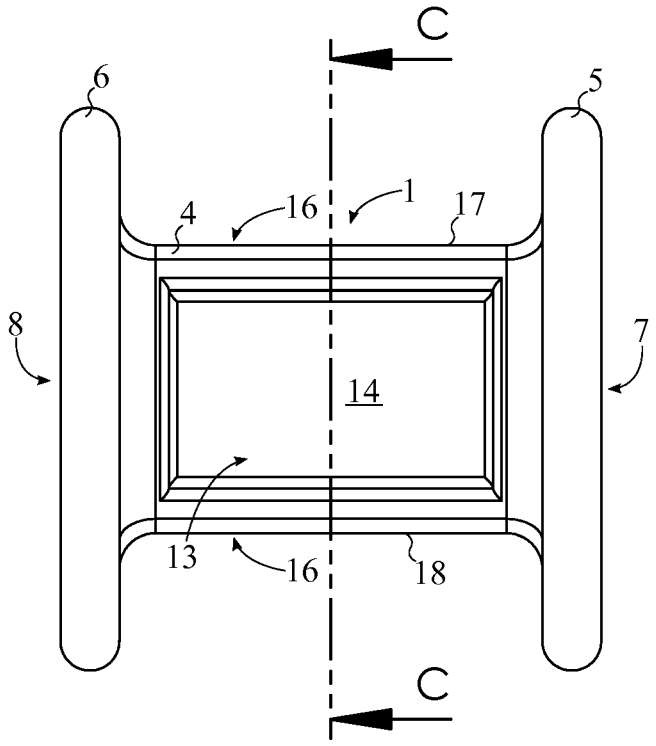
FIG. 11 is a front view of a fourth alternative embodiment of the present invention.

In a second alternative embodiment of the present invention shown in FIG. 8, the present invention further comprises a lanyard arch 11. The lanyard arch 11 is utilized to secure a lanyard clasp or clip to the present invention. The lanyard arch 11 is adjacently connected across the first lip 5, allowing the present invention to be attached to the lanyard clasp or clip from the first lip 5. Additionally, the present invention further comprises an opening 12. The lanyard clasp or clip may be inserted into the opening 12 in order to secure the present invention to the clasp or clip. The opening 12 is delineated between the lanyard arch 11 and the first concave cavity 7. As such, the lanyard arch 11 and the first concave cavity 7 are able to prevent the lanyard clasp or clip from separating from the present invention. The lanyard arch 11 is positioned perpendicular to the first base 2 allowing the lanyard arch 11 to protrude from the first base 2 in a manner such that the lanyard arch 11 does not prevent insertion and removal of the present invention into and from behind the firearm trigger.

Figure 12:
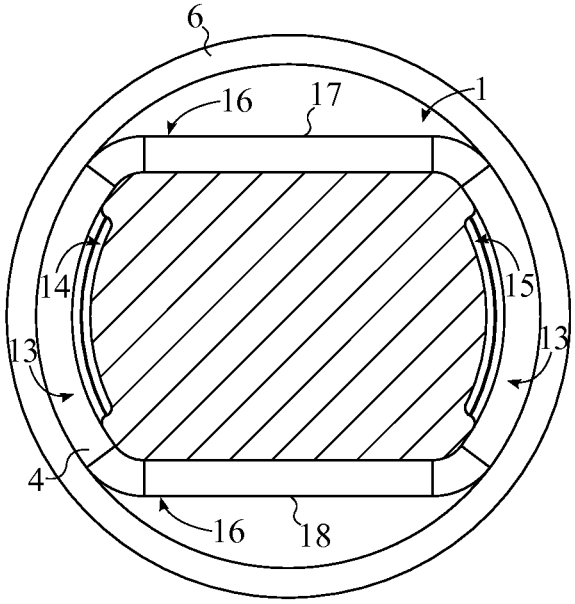
FIG. 12 is a cross-sectional view of the fourth alternative embodiment of the present invention taken along line C-C of FIG. 10.

A third alternative embodiment and a fourth alternative embodiment of the present invention are shown in FIGS. 9-10 and FIGS. 11-12, respectively. The third alternative embodiment and the fourth alternative embodiment of the present invention further comprise at least retention indentation 13. The at least one retention indentation 13 is able to accommodate a firearm trigger and/or a firearm trigger frame. The firearm trigger and/or the firearm trigger frame may be held in place within the at least one retention indentation 13 when the present invention is in use on a firearm. The at least one retention indentation 13 traverses into the lateral portion 4 providing a slot for the firearm trigger and/or the firearm trigger frame. The at least one retention indentation 13 comprises a first retention indentation 14 and a second retention indentation 15 as can be seen in FIG. 12. The first retention indentation 14 is positioned opposite to the second retention indentation 15. As such, the first retention indentation 14 may be utilized to accommodate the firearm trigger while the second retention indentation 15 may be utilized to accommodate the firearm trigger frame.

With further reference to FIGS. 9-12, the third alternative embodiment of the present invention further comprises at least one flat edge 16. The at least one flat edge 16 is able to facilitate rotation of the present invention once the present invention is in place behind the firearm trigger in order to reorient the lateral portion 4. The at least one flat edge 16 is positioned along the lateral portion 4, providing a flat surface on the lateral portion 4. Adjustment of the lateral portion 4 allows the user to increase or decrease the size of the cross-section of the lateral portion 4 with relation to the firearm trigger guard. This allows the present invention to be utilized with a wider variety of firearms. In the third alternative embodiment of the present invention shown in FIG. 10, the at least one flat edge 16 is a single flat edge. In the fourth alternative embodiment of the present invention shown in FIG. 11 and FIG. 12, the at least one flat edge 16 comprises a first flat edge 17 and a second flat edge 18. The first flat edge 17 is positioned opposite to the second flat edge 18, further facilitating rotation of the present invention.

Figure 13:
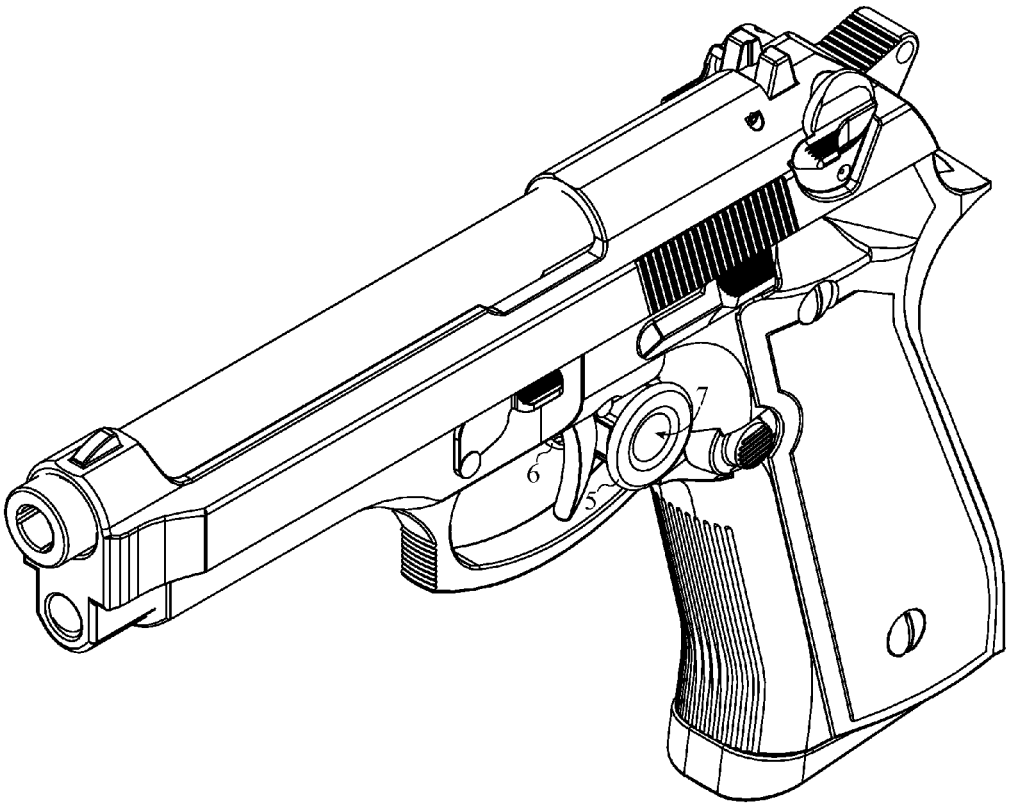
FIG. 13 is a front perspective view of the present invention in use with a firearm.
Figure 14:
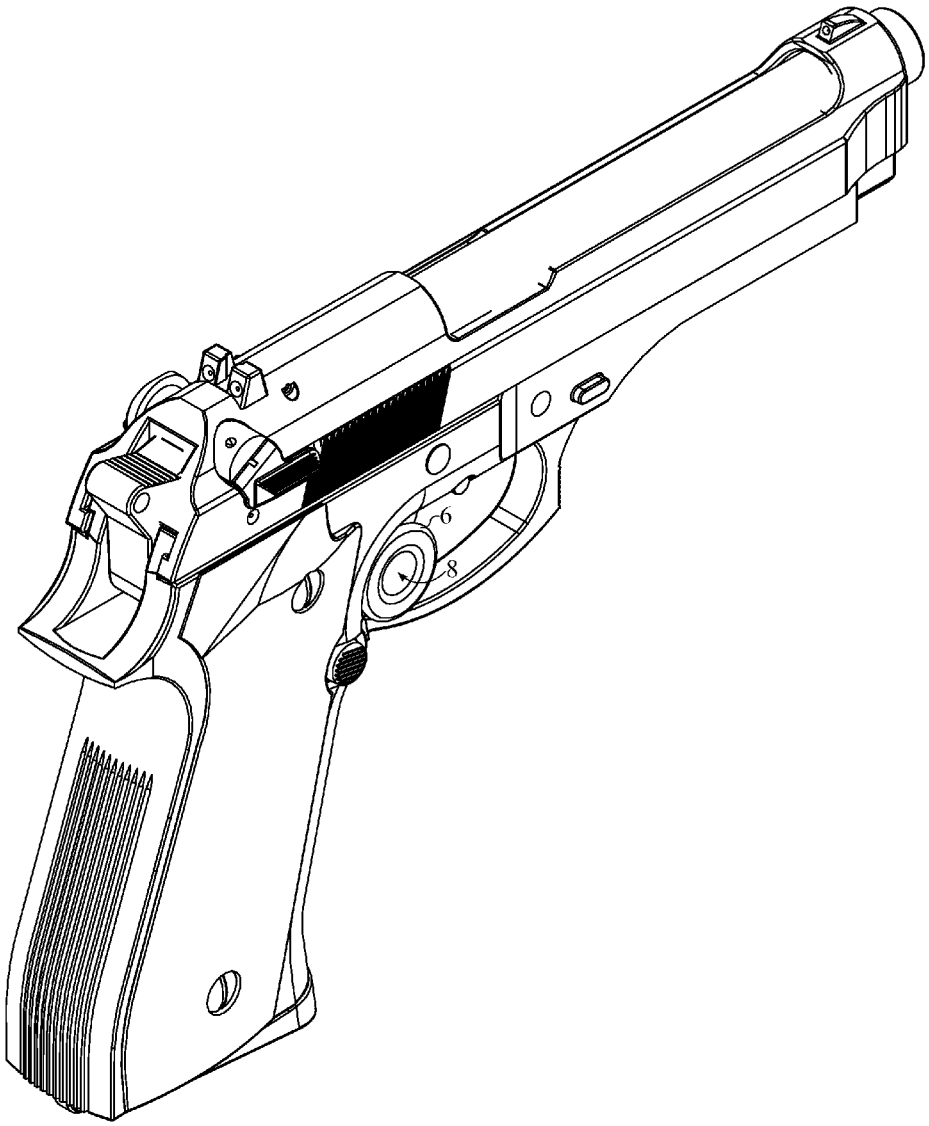
FIG. 14 is a rear perspective view of the present invention in use with a firearm.

The present invention is positioned behind a firearm trigger as shown in FIG. 13 and FIG. 14. The lateral portion 4 is positioned behind the firearm trigger while the first lip 5 and the second lip 6 prevent the present invention from becoming dislodged from behind the firearm trigger. The first concave cavity 7 and the second concave cavity 8 facilitate the insertion of the present invention behind the firearm trigger, allowing the user to simply press the present invention into position behind the firearm trigger. The present invention is first inserted by rotating the present invention in a manner such that the at least one flat edge 16 is positioned adjacent to the firearm trigger. Once the present invention is in place, the present invention is rotated in order to position the firearm trigger within the at least one retention indentation 14. The present invention is then held firmly in place in between the firearm trigger and the trigger guard. The flexibility of the present invention further aids in holding the present invention in place. Additionally, the flexibility and ability to turn the present invention when in place behind the firearm trigger allows the present invention to be utilized with a wide variety of firearm designs and sizes.

Although the present invention has been explained in relation to its preferred embodiment, it is understood that many other possible modifications and variations can be made without departing from the spirit and scope of the present invention as hereinafter claimed.

What is claimed is:

1. A trigger plug composed of flexible material, comprising:

a plug having a first annular lip at a first end, a second annular lip at a second end, and a cylindrical lateral portion extending between said first end and said second end and perpendicular to said first annular lip and said second annular lip, wherein said cylindrical lateral portion further includes a flat edge disposed thereon and extending between said first end and said second end of the plug and a retention indentation disposed upon said cylindrical lateral portion adjacent to said flat edge, the first end of said plug further including a first concave cavity; and the second end of said plug further including a second concave cavity.

2. The trigger plug of claim 1, wherein said first end and said second end are circular.

3. The trigger plug of claim 1, wherein said retention indentation extends between said first end and said second end of the plug.

4. The trigger plug of claim 1, wherein said cylindrical lateral portion is solid in cross-section.

5. The trigger plug of claim 1, wherein said plug is made of rubberized material.

6. The trigger plug of claim 1, further including a lanyard arch disposed within at least one of said first or second concave cavity.

7. The trigger plug of claim 6, wherein said lanyard arch includes an opening.

* * * * *